US011230415B2

(12) United States Patent
Gill et al.

(10) Patent No.: US 11,230,415 B2
(45) Date of Patent: Jan. 25, 2022

(54) CONTAINER WITH CAP STRUCTURE

(71) Applicant: Source Vagabond Systems Ltd., Tirat Ha'Carmel (IL)

(72) Inventors: Yoram Gill, Haifa (IL); Avner Balachsan, Pardes Hanna-Karkur (IL)

(73) Assignee: Source Vagabond Systems Ltd, Tirat Ha'Carmel (IL)

( * ) Notice: Subject to any disclaimer, the term of this patent is extended or adjusted under 35 U.S.C. 154(b) by 166 days.

(21) Appl. No.: 16/442,569

(22) Filed: Jun. 17, 2019

(65) Prior Publication Data

US 2020/0391914 A1 Dec. 17, 2020

(51) Int. Cl.

| | |
|---|---|
| ***B65D 47/14*** | (2006.01) |
| ***B65D 50/06*** | (2006.01) |
| ***B65D 51/18*** | (2006.01) |
| ***B65D 47/12*** | (2006.01) |
| ***B65D 55/16*** | (2006.01) |
| *B65D 41/62* | (2006.01) |

(52) U.S. Cl.

CPC ..... *B65D 51/18* (2013.01); *B65D 47/128* (2013.01); *B65D 55/16* (2013.01); *B65D 41/62* (2013.01); *B65D 47/14* (2013.01); *B65D 50/06* (2013.01); *B65D 2251/0015* (2013.01); *B65D 2251/0025* (2013.01); *B65D 2251/0081* (2013.01); *B65D 2251/0087* (2013.01)

(58) Field of Classification Search

CPC ..... B65D 41/17; B65D 41/47; B65D 41/62; B65D 41/185; B65D 50/06; B65D 50/061; B65D 50/062; B65D 50/04; B65D 47/128; B65D 47/148; B65D 47/147; B65D 47/127; B65D 47/121; B65D 47/141; B65D 2251/0015; B65D 2251/0087

USPC ..... 220/293, 301, 302; 215/221, 216, 225, 215/224, 223, 217

See application file for complete search history.

(56) References Cited

U.S. PATENT DOCUMENTS

| | | | | |
|---|---|---|---|---|
| 4,002,275 A * | 1/1977 | Crowle | ..... | B65D 47/148 222/543 |
| 4,433,790 A * | 2/1984 | Gibson | ..... | B65D 50/061 215/206 |
| 2003/0155322 A1 * | 8/2003 | Auer | ..... | B65D 41/185 215/321 |

(Continued)

FOREIGN PATENT DOCUMENTS

| | | | | |
|---|---|---|---|---|
| DE | 2052362 A1 * | 4/1972 | ..... | B65D 50/06 |

OTHER PUBLICATIONS

DE2052362_translation.pdf.*

International Search Report for PCT Application No. PCT/IL2020/050660 dated Jul. 28, 2020.

*Primary Examiner* — Allan D Stevens

(74) *Attorney, Agent, or Firm* — Pearl Cohen Zedek Latzer Baratz LLP

(57) ABSTRACT

A cap structure may include a base and a cap, where the base may include a periphery configured to be mounted over a rim of an opening of a container. The base may include a hollow neck, extending from the base for facilitating flow of liquid from the container through and out of the neck. The neck may include a flange extending annularly around the neck, so as to define an annular step. The cap may include a plurality of inwardly protruding projections, configured to snap over the step when the cap is mounted over the neck.

18 Claims, 11 Drawing Sheets

(56) References Cited

U.S. PATENT DOCUMENTS

| | | | | |
|---|---|---|---|---|
| 2005/0242054 | A1* | 11/2005 | Stull | B65D 41/325 215/252 |
| 2011/0226770 | A1 | 9/2011 | Teisberger | |
| 2014/0263453 | A1* | 9/2014 | Haley | C12H 1/14 222/152 |
| 2017/0297788 | A1 | 10/2017 | Defert | |
| 2017/0327283 | A1* | 11/2017 | Rosson | B65D 45/32 |
| 2018/0044073 | A1 | 2/2018 | Dong et al. | |

* cited by examiner

CONTAINER WITH CAP STRUCTURE

FIELD OF THE INVENTION

The present invention relates generally to containers of liquid. More specifically, the present invention relates to a container with a cap structure.

BACKGROUND OF THE INVENTION

Containers, such as bottles, jars and the like may include a top opening designed to allow filling and dispensing liquid into or out of the container. A cap may be provided to keep the liquid contained within the container inside and to avoid inadvertent spill.

Some state-of-the-art caps may be adapted to be attached to respective container neck openings by screwing the cap over the opening of the container in a rotational motion. Such motion may be experienced as somewhat annoying as it involves some rotation of the cap and as difficult in conditions where a user may have limited motion capabilities, such as in a case of a handicapped user or a user who may be practicing a sport while drinking from the container.

Some state-of-the-art container caps may be adapted to be attached to respective containers (e.g., bottles) by, for example, plugging the cap over the opening of the container in a direct linear motion. Such caps may require exertion of force in order be snapped in position and to obtain firm sealing of the container and may also require exertion of force in order to detach the cap from the opening. A force applied on the cap may cause unintentional disengagement of the cap.

SUMMARY OF THE INVENTION

Some embodiments of the invention may include a cap structure that may include a base and a cap. The base may include a periphery, configured to be mounted over a rim of an opening of a container.

The base may include a hollow neck that may extend from the base for facilitating flow of liquid from the container through and out of the neck. The neck may include a flange extending annularly around the neck, so as to define an annular step.

The cap may include a plurality of inwardly protruding projections configured to snap over the step when the cap is mounted over the neck.

The cap may include a rotatable sleeve configured to engulf the plurality of inwardly protruding projections. The rotatable sleeve may be configured to rotate between a first, default position and a second, rotated position.

In the first default position, the sleeve may prevent the plurality of inwardly protruding projections from retracting so as to hold the cap onto the neck.

In the second, rotated position, the sleeve may be configured to allow each of the plurality of inwardly protruding projections to retract, so as to allow removal of the cap from the neck.

The sleeve may include inwardly facing dents. The inwardly facing dents may, in the second rotated position, each face an inwardly protruding projection of the plurality of inwardly protruding projections. In this condition, each of the plurality of inwardly protruding projections may retract into one of the inwardly facing dents, to allow removal of the cap from the neck.

The sleeve may be coupled to a spring which may hold the sleeve in the default position and/or return the sleeve from the second, rotated position to the first, default position.

The cap may include an annular stopper that may be adapted to enter the hollow neck and may be associated with the sleeve (e.g., via chassis 380 and spring 350 as elaborated in relation to FIG. 7).

An inner side of the hollow neck may include an inlayed ridge that may be adapted to cooperate with the annular stopper, so as to stop a motion of the cap when the cap is pressed shut.

The inlayed ridge may include one or more portions that are slanted in relation to an axis parallel to a direction of mounting or dismounting of the cap from the neck, and the annular stopper may include one or more slanted indentations matching to the one or more slanted portions of the inlayed ridge.

The one or more slanted indentations of the annular stopper may be configured to cooperate with the one or more slanted portions of the inlayed ridge, so as to raise the cap with respect to the neck when the sleeve is turned.

The cap may include a chassis, attached to the spring on a first side, and thus coupled to the sleeve on the first side, and attached to the annular stopper on a second side.

The chassis may include a plurality of apertures, adapted to respectively house the plurality of inwardly protruding projections, while enabling the protruding projections to reach the annular step when the cap is closed.

The cap may include a ring gasket adapted to seal a gap between the chassis and the hollow neck, to prevent leakage of fluid therethrough.

The spring may be fixed at a first end in an aperture that may be included in the chassis and may thus be attached to the chassis. The spring may be fixed at a second end in an aperture that may be included in the sleeve and may thus couple the chassis to the sleeve. This coupling may allow a user to rotate the sleeve in relation to the chassis from the default position to the rotated position and may return the sleeve back to the default position when the rotation stops.

The cap may further include a ring, having a first protrusion, and the base may include a respective, second protrusion. The first protrusion and second protrusion may be connectable by a lace, so as to secure the cap.

Some embodiments of the invention may include a container assembly. The container assembly may include a container configured to hold liquid, a base and a cap. The base may include a periphery configured to be mounted over a rim of an opening of the container and the base may include a hollow neck, extending from the base for facilitating flow of the liquid therethrough. The neck may include a flange extending annularly around the neck, so as to define an annular step, and wherein the cap may include a plurality of inwardly protruding projections configured to snap over the step when the cap is mounted over the neck.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1B:
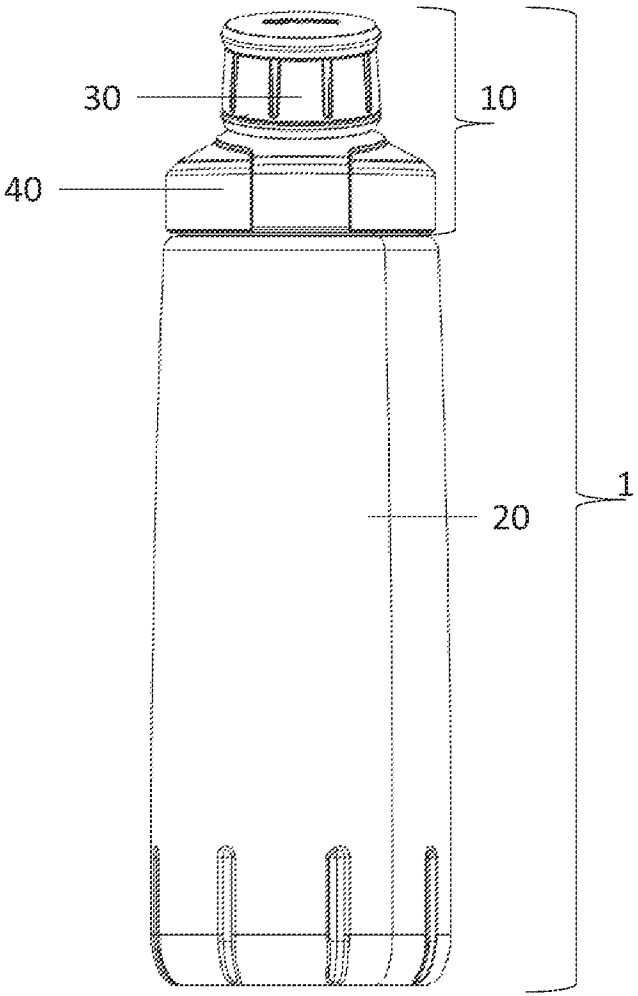
FIG. 1B is an illustration depicting another side view (substantially orthogonal to the view of FIG. 1A) of the container assembly with a cap structure shown in FIG. 1A.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention. Some features or elements described with respect to one embodiment may be combined with features or elements described with respect to other embodiments. For the sake of clarity, discussion of same or similar features or elements may not be repeated.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. The term set when used herein may include one or more items. Unless explicitly stated, the method embodiments described herein are not constrained to a particular order or sequence. Additionally, some of the described method embodiments or elements thereof can occur or be performed simultaneously, at the same point in time, or concurrently.

Some embodiments of the present invention may include a container assembly, including a container that may be adapted to hold liquid (e.g., a bottle) and a corresponding cap structure. The cap structure may include a base which may be mounted onto an opening of the container and/or attached to the container, and a cap which may be attached to the base, so as to seal off the container and maintain liquid within the container when the cap is secured to the base.

A cap according to some embodiments of the invention may be engaged with a hollow neck extending from the base using a linear motion. Thus, the cap structure may enable rapid mounting and dismounting of the cap, so as to seal off the neck or expose it for filling or dispensing liquid into or out of the container without requiring a rotational screw motion.

For example, the cap may be mounted onto the neck using a linear motion, in a direction that is substantially perpendicular to a central axis of the neck, as explained hereinafter.

According to some embodiments of the invention, the cap may include one or more appropriate attachment elements and may be attached and/or fastened to the neck by the one or more attachment elements as known in the art. For example, the one or more attachment elements may include one or more inwardly protruding projections or teeth (such as projections 330 of FIG. 7) extending from the cap to the neck and adapted to attach the cap to the neck.

According to some embodiments of the invention, the cap may be configured to detach or "pop off" the base by a slight or small rotational or twisting motion of the cap or part thereof in relation to the base. The term "small rotation" or "slight rotation" may relate to a rotation that is substantially less than full rotation about the neck (e.g., a fraction of the cap's perimeter, such as, for example, 5-40 degrees) and/or may be significantly shorter than a rotational motion required for screwing a cap off a container.

According to some embodiments of the invention, a slight rotational motion may enable retraction of the one or more attachment elements from the neck and may thus enable detachment of the cap from the neck by a simple linear motion in a direction substantially parallel to a central axis of the neck, as explained herein.

Additionally, or alternately, a slight rotational motion may enable retraction of the one or more attachment elements from the neck and may thus enable detaching or "popping off" of the cap from the neck by an additional rotational motion, as elaborated herein.

According to other embodiments of the invention, the cap may be configured to detach or pop off the base by a single linear motion in a direction substantially parallel to a central axis of the neck (e.g., without requiring a rotational motion).

For example, the one or more attachment elements may include a flexible portion, adapted to be overcome by a linear pull motion, so as to retract from the neck and enable detachment of the cap from the neck.

In another example, the one or more attachment elements maybe associated with any appropriate releasing mechanism as known in the art, such as a releasing button. The releasing mechanism may be adapted to retract the one or more attachment elements from the neck and enable detachment of the cap from the neck by a linear motion in a direction substantially parallel to a central axis of the neck.

Figure 1A:
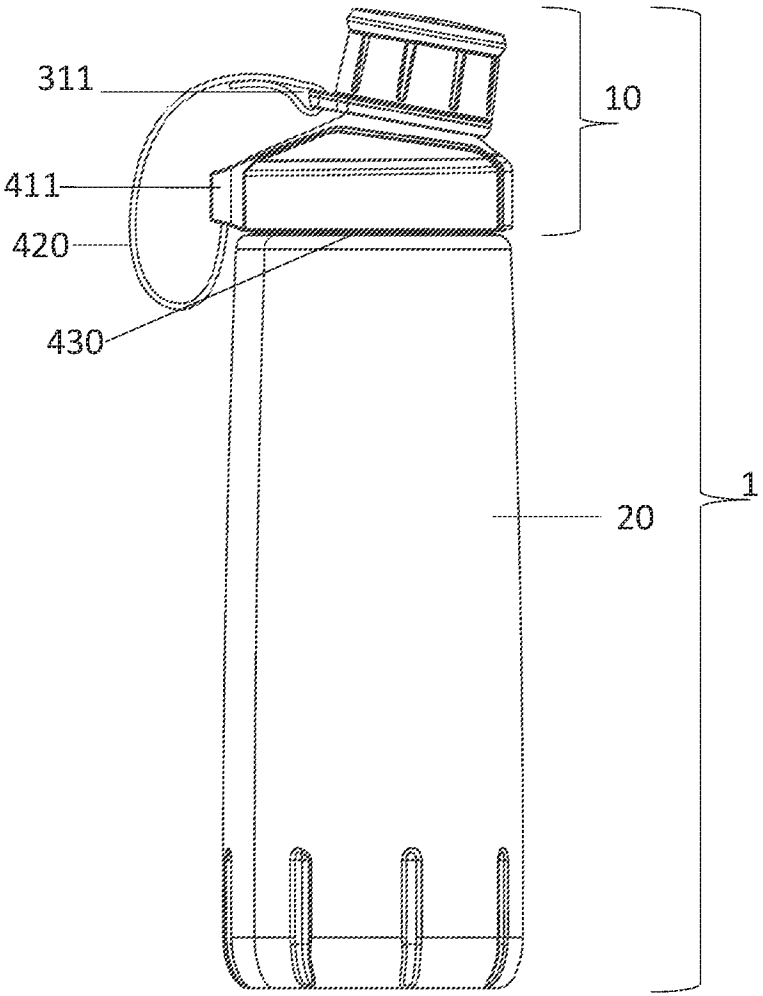
FIG. 1A is an illustration depicting a side view of a container assembly with a cap structure, according to some embodiments of the invention.
Figure 1C:
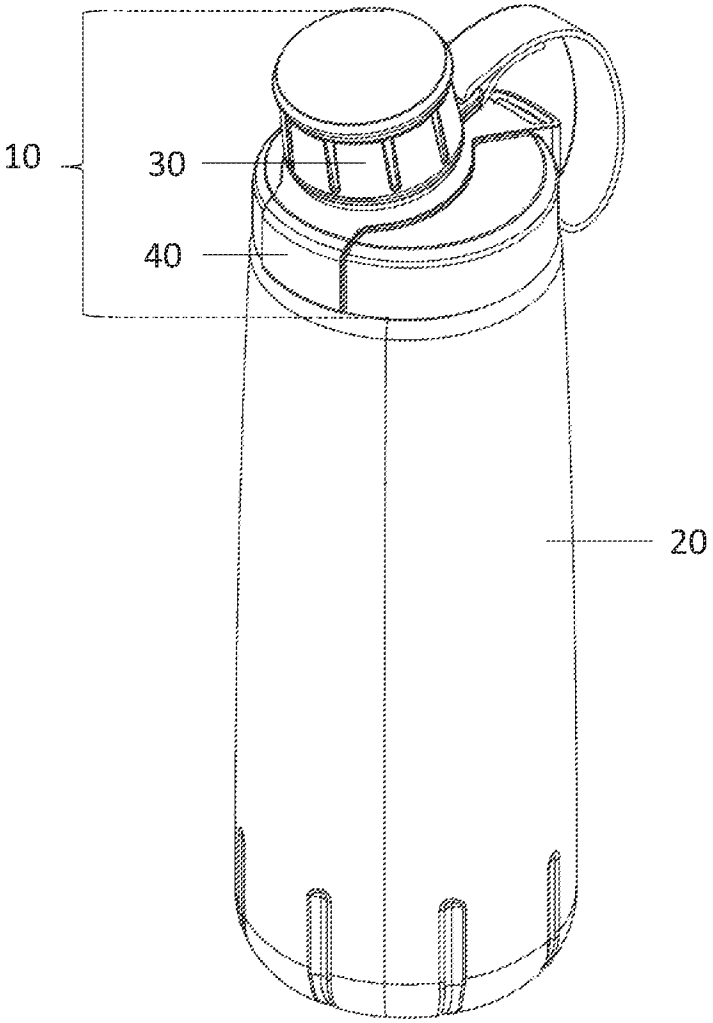
FIG. 1C is an illustration depicting an isometric top view of the container assembly shown in FIG. 1A.

Reference is now made to FIGS. 1A, 1B and 1C. FIG. 1A is an illustration depicting a side view of a container with a cap structure, according to some embodiments of the invention. FIG. 1B is an illustration depicting another side view (substantially orthogonal to the view of FIG. 1A) of the container with a cap structure shown in FIG. 1A. FIG. 1C is an illustration depicting an isometric top view of the container assembly shown in FIG. 1A.

As shown in FIGS. 1A, 1B and 1C, container assembly 1 may include a container 20, designed so as to hold liquid therein, and may include a corresponding cap structure 10. Cap structure 10 may include a base 40 which may be mounted onto an opening of container 20. For example, base 40 may include a periphery 430 that may match the opening of container 20 and may be adapted or configured to be fitted or mounted over the opening of container 20, for example by screwing the base over the opening rim of container 20, as explained herein in relation to FIG. 2.

In some embodiments of the invention, periphery 430 may interface or be attached to (e.g., screwed onto) a corresponding interface at the opening of container 20.

Cap structure 10 may further include a cap 30, which may be mounted over a hollow neck (see 450 in FIG. 3A) of base 40, so as to close or seal an opening at the top of the neck of container 20.

According to some embodiments of the invention, cap 30 may include a ring having a first protrusion 311, and base 40 may include a respective, second protrusion 411. According to some embodiments of the invention, first protrusion 311 and second protrusion 411 may be connectable by a lace 420, so as to secure cap 30 (e.g., from falling when cap 30 is not attached to base 40).

Figure 2:
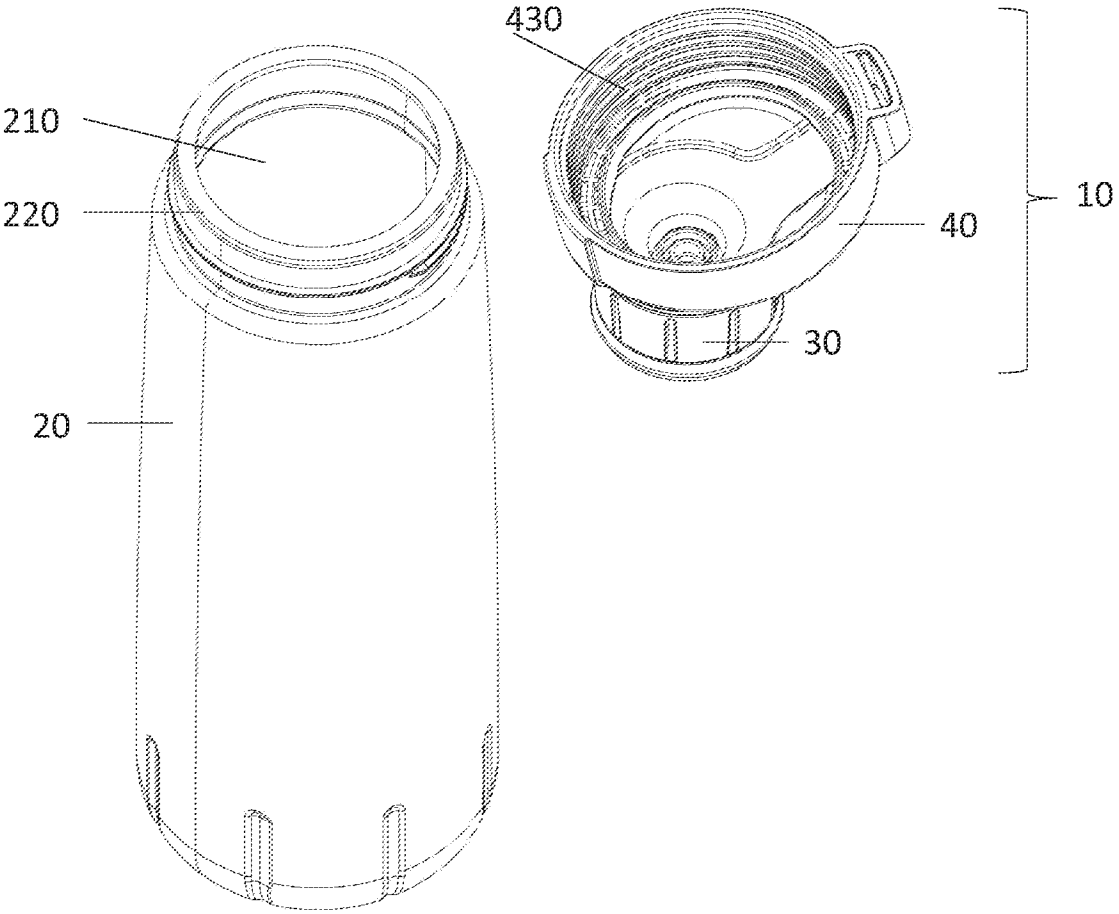
FIG. 2 is an illustration depicting an isometric view of a container and a cap structure, according to some embodiments of the invention.

FIG. 2 is an illustration depicting an isometric view of a container 20 and a respective cap structure 10, according to some embodiments of the invention. As shown in FIG. 2, cap structure 10 may include an assembly of a cap 30 and a base 40. As shown in FIG. 2, base 40 may include a periphery 430 configured to be mounted over an opening 210 of container 20. In the example depicted in FIG. 2, periphery 430 may include an interface such as an internal screw thread, enabling attachment of base 40 to a corresponding interface, such as a corresponding external screw thread at a rim 220 of opening 210 of container 20.

Figure 3B:
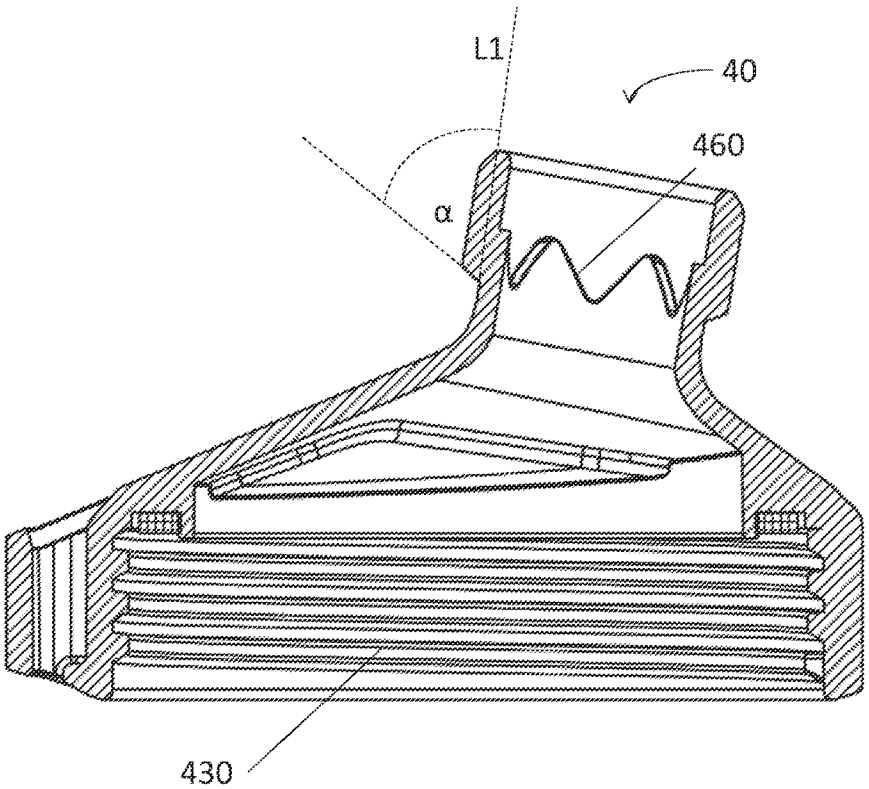
FIG. 3B is an illustration of a cross-section view of the base of the cap structure shown in FIG. 3A.
Figure 3A:
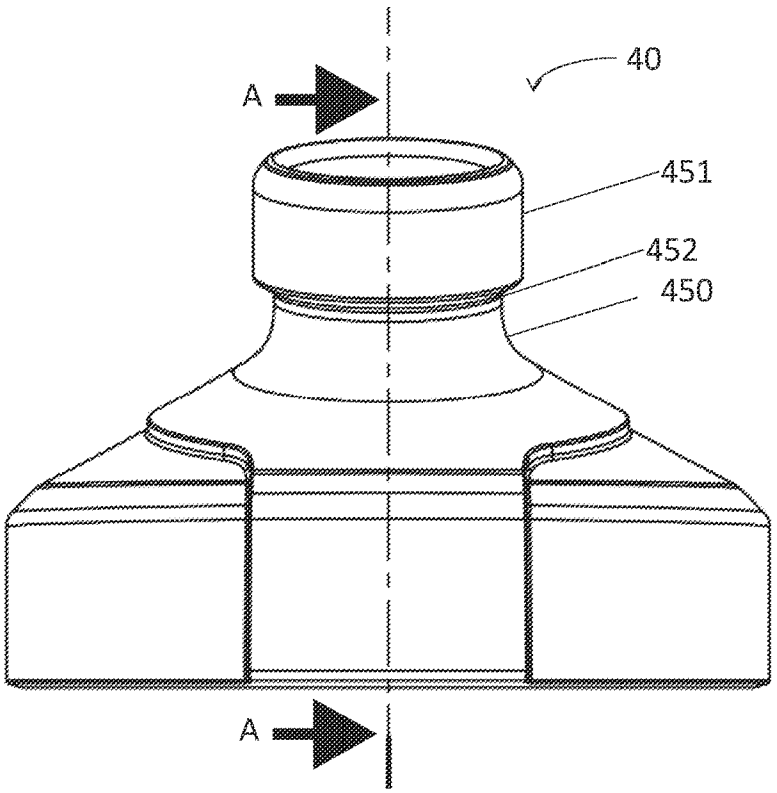
FIG. 3A is an illustration depicting a side view of a base of a cap structure, according to some embodiments of the invention.

Reference is now made to FIGS. 3A and 3B. FIG. 3A is an illustration depicting a side view of base 40, according to some embodiments of the invention, indicating section line A-A. FIG. 3B is an illustration depicting a cross-section view of base 40 along section line A-A, according to some embodiments of the invention.

As shown in FIGS. 3A and 3B, base 40 may include a hollow neck 450, extending from the base for facilitating flow of liquid from the container through and out of the neck. Neck 450 may include a flange 451, extending annularly around the neck, so as to define an annular step 452.

As shown in FIG. 3B, annular step 452 may be slanted (e.g., as marked by angle $\alpha$) in relation to a line substantially parallel to a wall of the neck (e.g., as marked by line L1). As explained herein in relation to FIGS. 9B and 9C, slanted step 452 may cooperate with one or more elements of cap structure 30 (e.g., flexible portion 332 of FIG. 9B) to attach cap 30 to base 40 and/or detach cap 30 from base 40.

As explained herein, cap 30 may include a plurality (e.g., three) inwardly protruding projections or teeth (e.g., projections 330 in FIG. 5), configured to snap over step 452 when the cap is mounted over the neck, so as to hold the cap in place over neck 450.

Figure 4B:
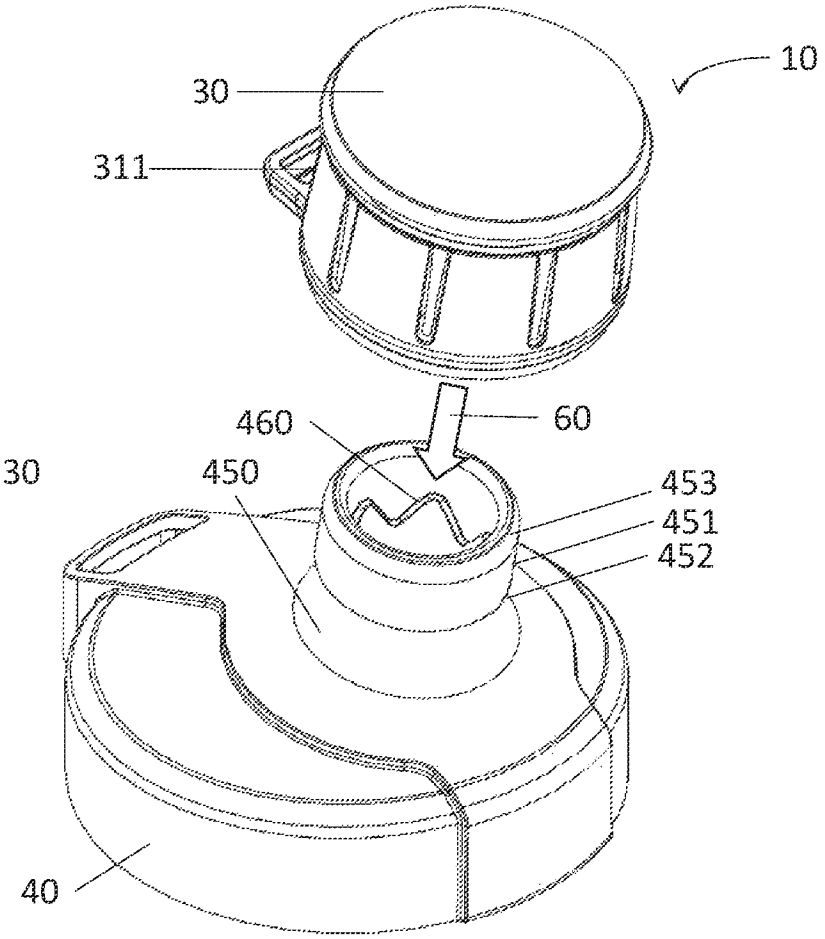
FIG. 4B is an illustration depicting an isometric top view of a cap structure, with a cap detached from the base, according to some embodiments of the invention.
Figure 4A:
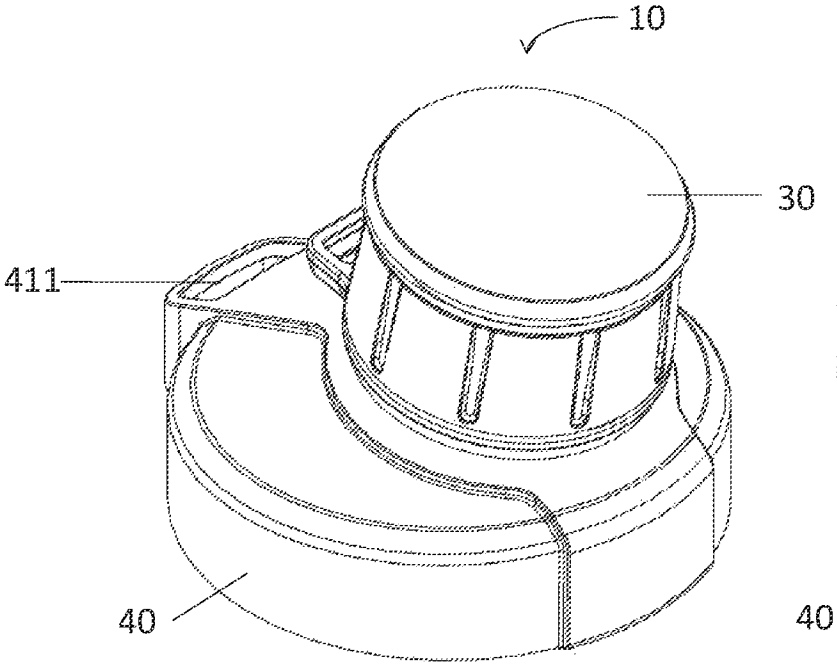
FIG. 4A is an illustration depicting an isometric top view of a cap structure, with a cap attached to the base of the cap structure, according to some embodiments of the invention.
Figure 5:
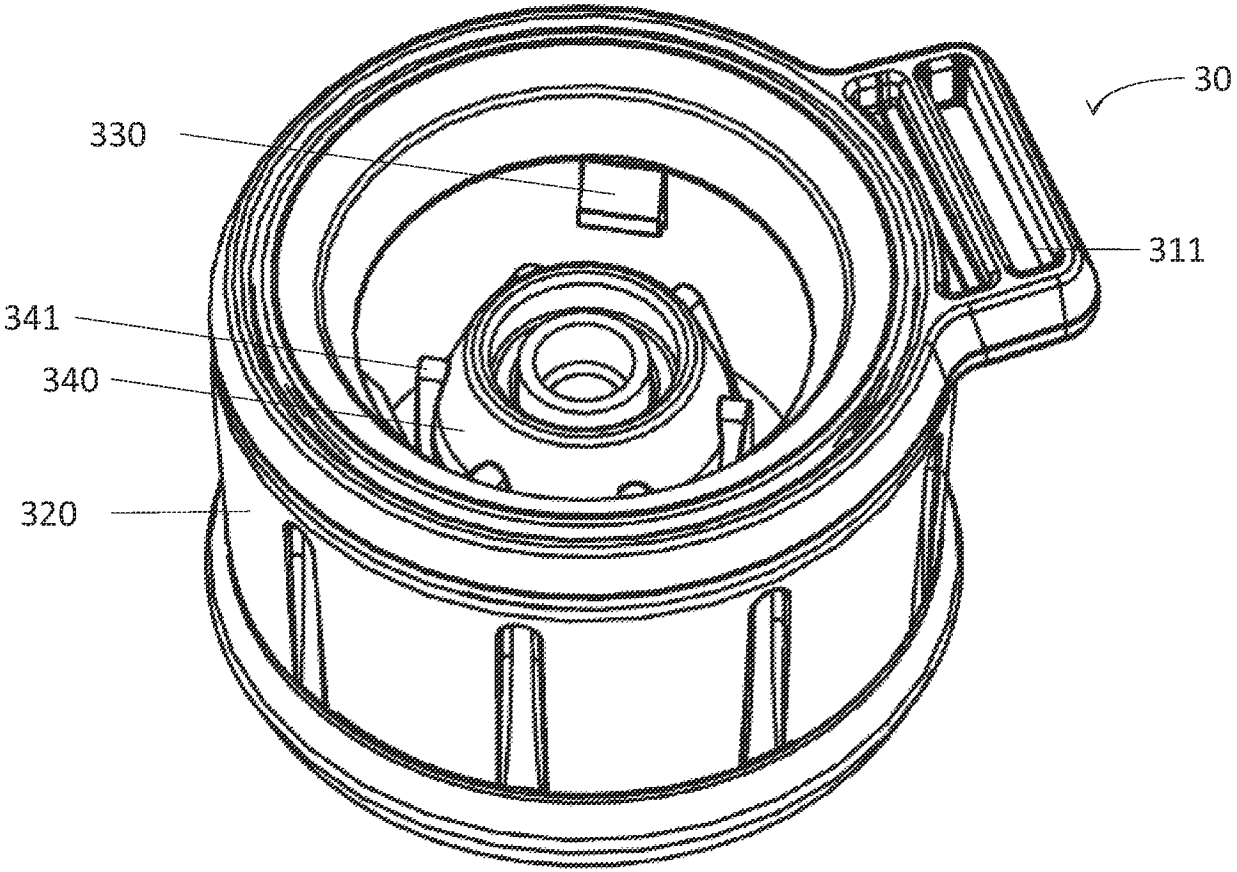
FIG. 5 is an illustration depicting an isometric bottom view of a cap, according to some embodiments of the invention.

Reference is now made to FIGS. 4A, 4B and 5. FIG. 4A is an illustration depicting an isometric top view of a cap structure 10, with a cap 30 attached to the base 40 of the cap 30, according to some embodiments of the invention. FIG. 4B is an illustration depicting an isometric top view of a cap structure, with a cap detached from the base, according to some embodiments of the invention. FIG. 5 is an illustration depicting an isometric bottom view of a cap, according to some embodiments of the invention.

As shown in FIG. 4B, cap 30 may be mounted onto neck 450 of base 40 by moving it in a linear motion indicated by arrow 60, so as to seal neck 450 (e.g., preventing liquid from passing through hollow neck 450) as shown in FIG. 4A.

As shown in FIG. 5, cap 30 may include an annular stopper 340, adapted to enter or be plugged into hollow neck 450. An inner side of hollow neck 450 may include an inlayed ridge 460 (see FIG. 4B), adapted to cooperate with a matching structure (see indentations 341 in FIG. 7) on annular stopper 340, acting as a supporting stopper to securely support the cap when the cap is placed over the neck.

According to some embodiments of the invention, inlayed ridge 460 may include one or more portions that are slanted in relation to an axis parallel to a direction of mounting or dismounting of the cap from the neck (e.g., slanted in relation to an axis parallel to arrow 60). Annular stopper 340 may include one or more slanted indentations 341 matching to the one or more slanted portions of inlayed ridge 460. The one or more slanted indentations 341 may be configured to cooperate with the one or more slanted portions of inlayed ridge 460, so as to raise cap 30 with respect to neck 450 when annular stopper 340 is rotated.

Additionally, or alternately, annular stopper 340 may be associated with a sleeve 320, for example by a connecting element such as a spring, as elaborated herein. Accordingly, turning sleeve 320 may press the one or more slanted indentations 341 against the one or more slanted portions of inlayed ridge 460. This pressure may raise cap 30 with respect to neck 450 when sleeve 320 is turned.

Figure 6B:
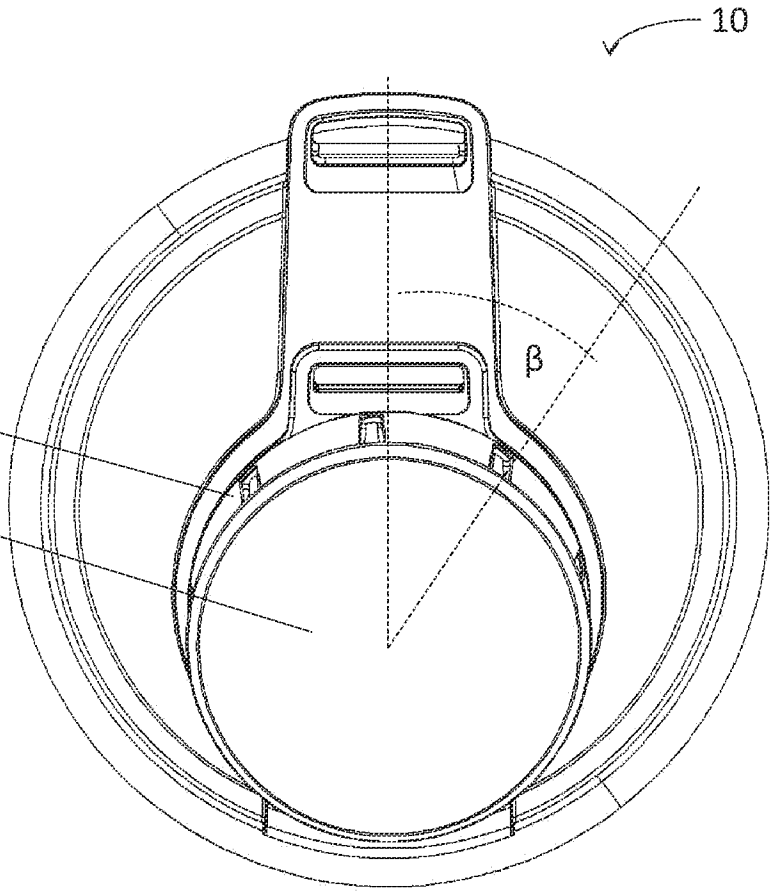
FIG. 6B is an illustration of the cap structure of FIG. 6A, with the cap at a second, rotated position, according to some embodiments of the invention.
Figure 6A:
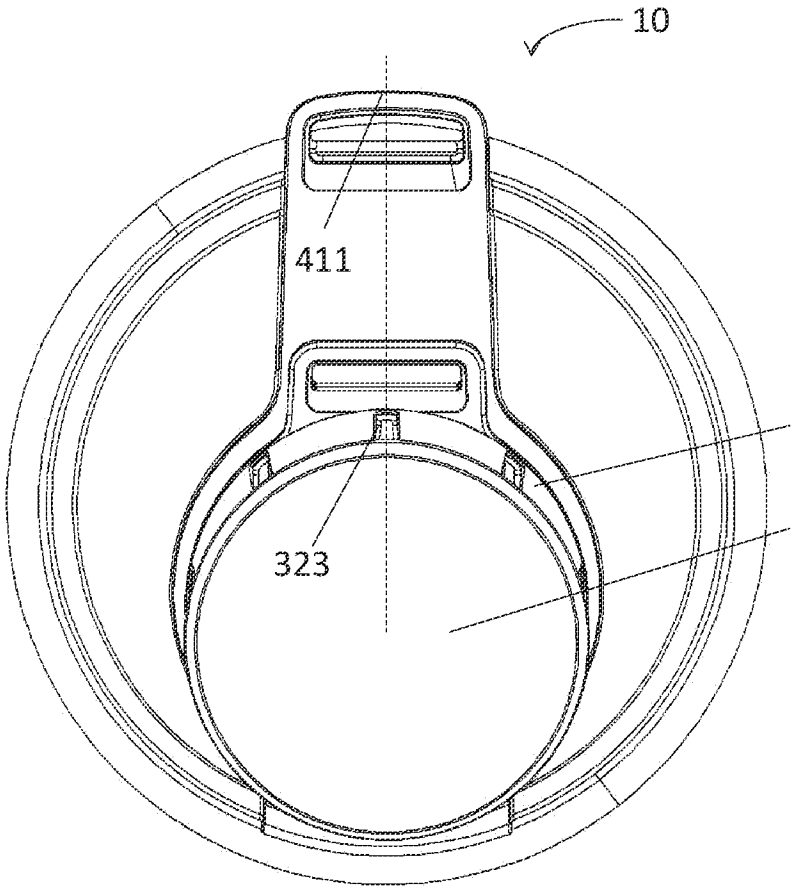
FIG. 6A is an illustration depicting a top view of a cap structure, with the cap at a first, default position, according to some embodiments of the invention.

Reference is now made to FIGS. 6A and 6B. FIG. 6A is an illustration depicting a top view of a cap structure, with the cap at a first, default position, according to some embodiments of the invention. FIG. 6B is an illustration of the cap structure of FIG. 6A, with the cap at a second, rotated position, according to some embodiments of the invention.

According to some embodiments of the invention, cap 30 may include a rotatable sleeve 320 configured to rotate, for example, by applying a twisting motion, between a first, default position and a second, rotated position. Rotatable sleeve 320 may be linked to cap 30 via a spring. Sleeve 320 may be coupled to a spring (see for example, 350 in FIG. 7), which may hold sleeve 320 in the default position. (e.g., when no force is applied to the sleeve). The spring may also be configured to return sleeve 320 to the default position when the sleeve is rotated to the second rotated position and then released.

As shown in FIG. 6A, at the default position, a first feature of the cap (e.g., an indentation 323 in sleeve 320) may be aligned with a second feature of the cap assembly 10 (e.g., a centerline of protrusion 411). As shown in FIG. 6B, at the rotated position, sleeve 320 may be rotated such that the first feature (e.g., indentation 323) may be angularly displaced (e.g., marked as angle 'β') in relation to the default position.

As elaborated herein, at the first, default position, the sleeve may engulf one or more elements such as one or more projections (e.g., projections 330 of FIG. 5) so as to hold cap 30 onto neck 450 and prevent the cap from detaching from neck 450 of base 40. Additionally, or alternatively, at the second, rotated position, sleeve 320 may enable one or more elements of cap 30 such as the one or more projections (e.g., projections 330 of FIG. 5) to move or retract from neck 450, allowing removal of cap 30 from neck 450.

Figure 7:
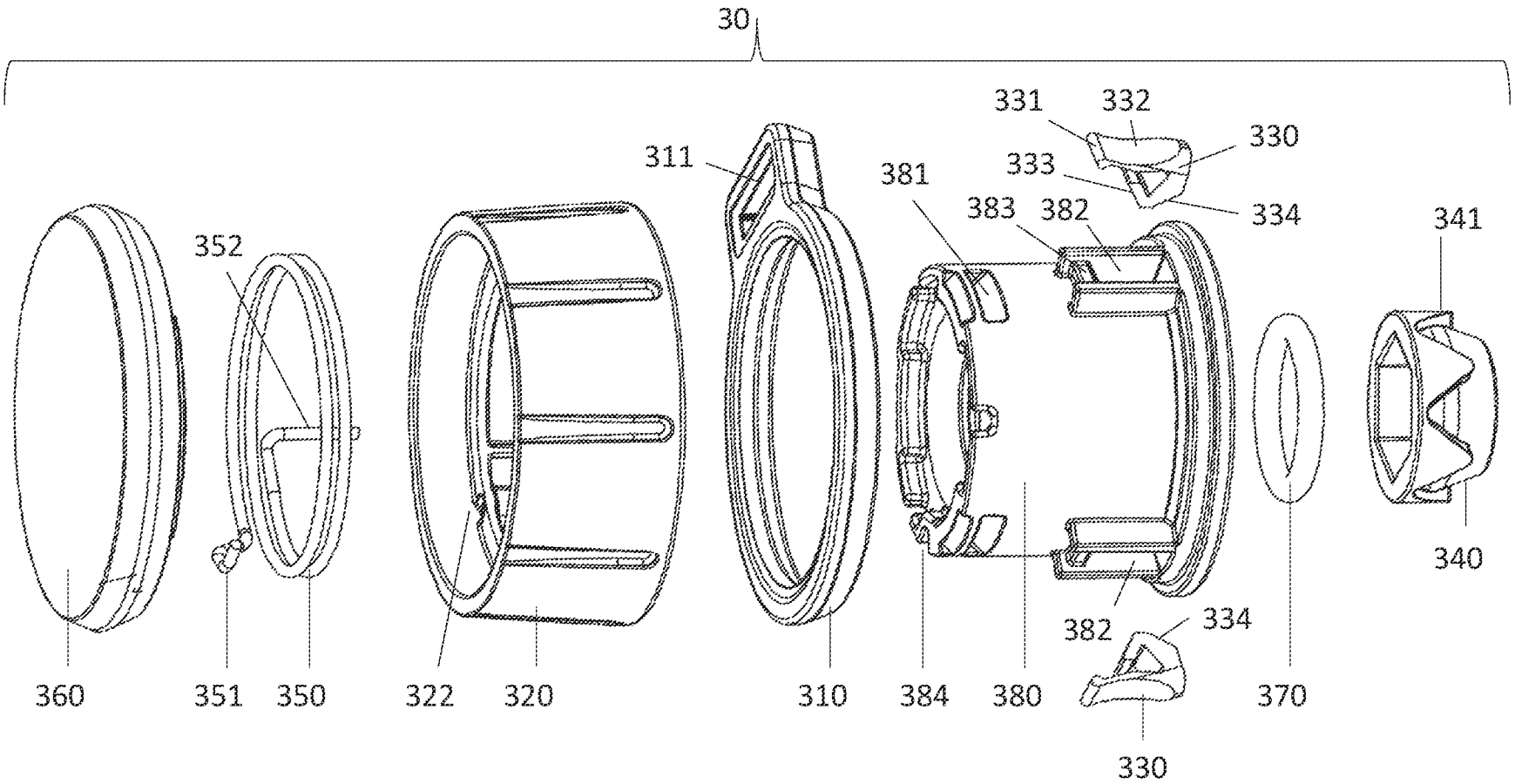
FIG. 7 is an exploded view of a cap, according to some embodiments of the invention.

Reference is now made to FIG. 7, which is an exploded side perspective view of a cap, according to some embodiments of the invention. As shown in FIG. 7, cap 30 may include: a plate 360, a spring 350, a sleeve 320, a ring 310, a chassis 380, a gasket 370, an annular stopper 340 and a plurality of (e.g., three) inwardly protruding (e.g., substantially toward a radial center of cap 30) projections 330.

As explained in relation to FIG. 5, annular stopper 340 may act as a supporting stopper to securely support cap 30 when the cap is placed over neck 450 of base 40. Slanted indentations 341 of annular stopper 340 may cooperate with the slanted portions of inlayed ridge (e.g., inlayed ridge 460 of FIG. 4B) to raise cap 30 over neck 450 of base 40.

Annular stopper 340 may be attached to chassis 380 on a first side of chassis 380. For example, chassis 380 may be attached to annular stopper 340 via a ring or gasket 370 adapted to seal a gap between chassis 380 and hollow neck 450 of base 40, to prevent leakage of fluid from container 20, as explained herein, in relation to FIG. 9B. Additionally, or alternatively, when cap 30 is attached to neck 450, annular stopper 340 may be adapted to hold or secure gasket 370 into place, to prevent leakage of fluid from container 20.

Chassis 380 may be inserted or threaded through ring 310 and sleeve 320 and may be attached to cap 360. For example, plate 360 may include one or more protrusions (e.g., protrusions 361 of FIG. 9C), configured to snap onto one or more respective apertures 381 in chassis 380, so as to attach chassis 380 to plate 360.

Chassis 380 may be attached to spring 350 on a second side of chassis 380 and may thus be coupled, via spring 350, to sleeve 320 on the second side. For example, spring 350 may be attached or fixed at a first end 351 of spring 350 to a respective aperture 384 included in chassis 380 and may thus be attached to chassis 380. As explained herein, plate 360 may be attached to chassis 380 at the one or more apertures 381. Plate 360 may thus support spring 350 at the first end 351 when located at aperture 384, so as to prevent first end 351 from detaching from aperture 384.

Spring 350 may be attached or fixed at a second end 352 of spring 350 to a respective aperture 322 included in sleeve 320. Chassis 380 may thus be coupled at the second side to sleeve 320 via spring 350 and plate 360. Sleeve 320 may thus be rotated (e.g., by a user) in relation to chassis 380 from the default position (e.g., as depicted in FIG. 6A) to the rotated position (e.g., as depicted in FIG. 6B), and return back to the default position when the rotation stops.

According to some embodiments of the invention, chassis 380 may include a plurality (e.g., three) of apertures 382, adapted to respectively house the plurality of inwardly protruding projections 330, while enabling the protruding projections 330 to reach annular step 452 when the cap is closed.

Sleeve 320 may include a plurality (e.g., three) recessed portions or dents 321, configured to engulf the respective plurality (e.g., three) of inwardly protruding projections 330.

When sleeve 320 is positioned at the first, default position, sleeve 320 may hold the plurality of inwardly protruding projections 330 at the respective plurality of apertures 382, so as to prevent the plurality of inwardly protruding projections from retracting, and thus holding the cap onto the neck (e.g., neck 450 of FIG. 3A).

When sleeve 320 is positioned at the second, rotated position, sleeve 320 may enable the plurality of inwardly protruding projections 330 to retract into a the respective inwardly facing dents (see dents 321 of FIG. 8C), allowing removal of the cap from the neck.

According to some embodiments of the invention, the plurality of projections 330 may include a first interface 331 and chassis 380 may include respective plurality of second corresponding interfaces 383. First interface 331 may be adapted to connect to second, corresponding interface 383. For example, first interface 331 and second, corresponding interface 383 may form a hinge, connecting the plurality of inwardly protruding projections 330 by interface 331 to chassis 380, at the location of the respective plurality of second interfaces 383.

The plurality of inwardly protruding projections 330 may include a first face 333 and a second face 334.

First face 333 may be adapted to interface the slanted face of annular step 452, when cap 30 is attached to neck 450. At this condition, first face 333 may be put substantially in a parallel plane to the slanted face of annular step 452 so as to enable first face 333 to slide over step 452, as explained herein in relation to FIG. 9C.

The plurality of inwardly protruding projections 330 may include a flexible portion 332, connecting interface 331 with first face 333 and second face 334.

As elaborated herein in relation to FIG. 4B, cap 30 may be mounted onto neck 450 of base 40 by moving it in a linear motion indicated by arrow 60, so as to seal neck 450. When cap 30 is linearly pushed in the direction of arrow 60, second face 334 of the plurality of projections 330 may meet a respective face 453 of neck 450. As cap 30 is further pushed in the direction of arrow 60, flexible portion 332 may be contracted so as to enable face 334 to overcome flange 451, until face 333 comes into contact with respective face 452 of neck 450.

When cap 30 is positioned at the first, default position, face 333 of inwardly protruding projections 330 may be in contact with respective face 452 of neck 450. Sleeve 320 may hold inwardly protruding projections 330 so as to force first face 333 to interface the slanted face of annular step 452 and thus attach cap 30 to neck 450.

When cap 30 is positioned at the second, rotated position, inwardly protruding projections 330 may face respective inwardly facing recessed portions or dents 321 of sleeve 320. At this position, the plurality of projections 330 may be allowed to retract into the respective dents 321. At this position, cap 30 may be pulled from neck 450 in a linear motion (e.g., as shown by arrow 61 of FIG. 9C). Face 333 may cooperate with respective face 452 of neck 450, and may thus retract into respective dents 321, to leave flange 451 and enable detaching of cap 30 from base 40.

Figure 8A:
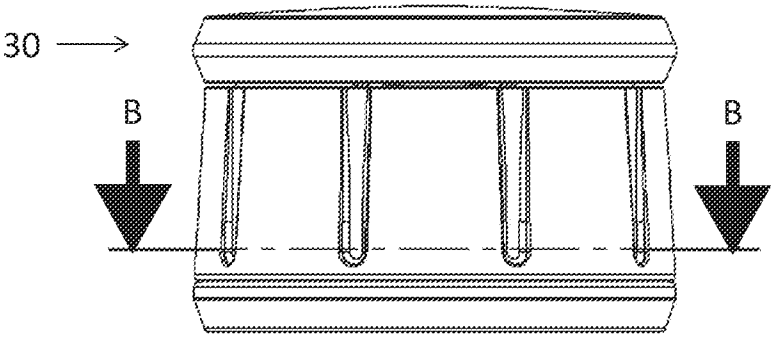
FIG. 8A is an illustration depicting a side view of the cap, according to some embodiments of the invention.
Figure 8B:
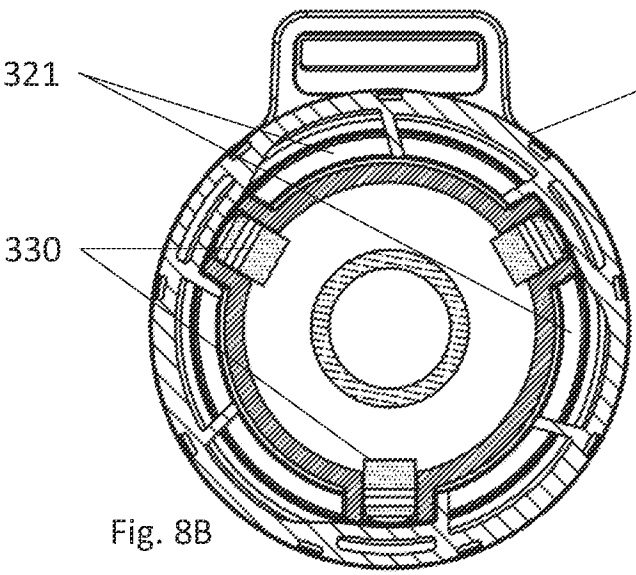
FIG. 8B is an illustration depicting a top view cross-section of a cap, according to some embodiments of the invention.
Figure 8C:
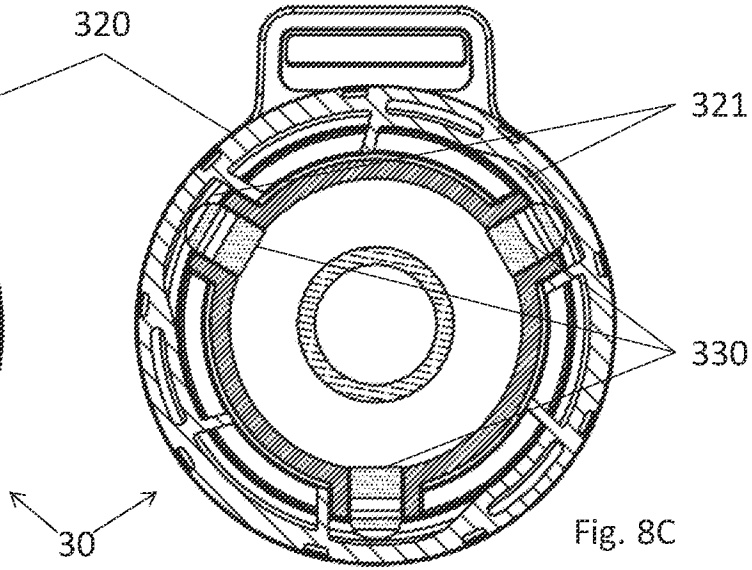
FIG. 8C is an illustration depicting another top view cross-section of the cap, according to some embodiments of the invention.

Reference is now made to FIGS. 8A, 8B and 8C. FIG. 8A is an illustration depicting a side view of cap 30, according to some embodiments of the invention, indicating a section line B-B. FIG. 8B is an illustration depicting a top view cross-section of cap 30 along section line B-B, when the inwardly protruding projections 330 are snapped over annular step 452, according to some embodiments of the invention. FIG. 8C is an illustration depicting a top view cross-section of cap 30 along section line B-B, when the inwardly protruding projections are retracted, according to some embodiments of the invention.

As elaborated herein in relation to FIGS. 6A and 5B, cap 30 may include rotatable sleeve 320, which may be rotated or twisted between a first, default state and a second, rotated state. As explained herein in relation to FIG. 7, sleeve 320 may include a plurality (e.g., three) recessed portions or dents 321, configured to engulf the respective plurality (e.g., three) of inwardly protruding projections 330.

As depicted in FIG. 8B, in the first, default position the sleeve may prevent the plurality of inwardly protruding projections from retracting so as to hold the cap onto the neck (e.g., neck 450 of FIG. 3A).

As depicted in FIG. 8C, in the second, rotated position each of the plurality of inwardly facing recessed portions or dents 321 may face a respective inwardly protruding projection 330. In this position, each of the plurality of inwardly protruding projections 330 may retract into one of the respective inwardly facing dents 321, allowing removal of the cap from the neck.

Figure 9B:
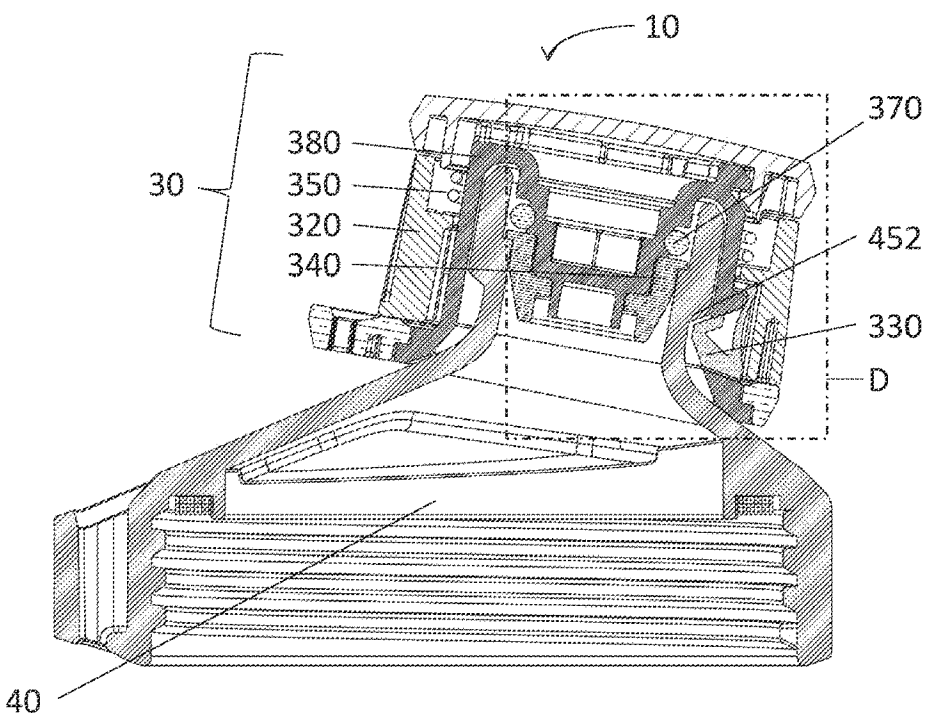
FIG. 9B is an illustration depicting a cross-section view of cap structure 10 along section line C-C and indicating an enlargement zone D.
Figure 9A:
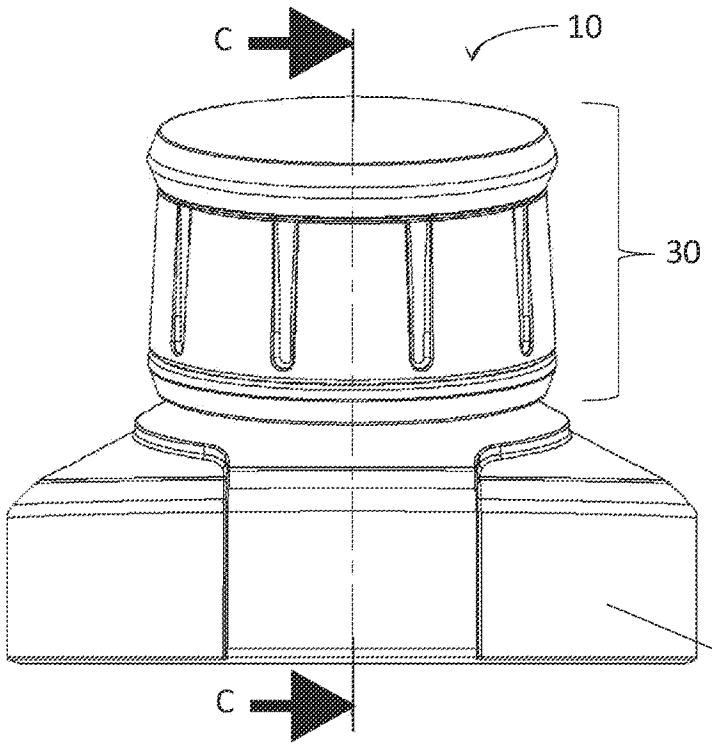
FIG. 9A is an illustration depicting a rear view the cap structure according to some embodiments of the invention, indicating a section line C-C.
Figure 9C:
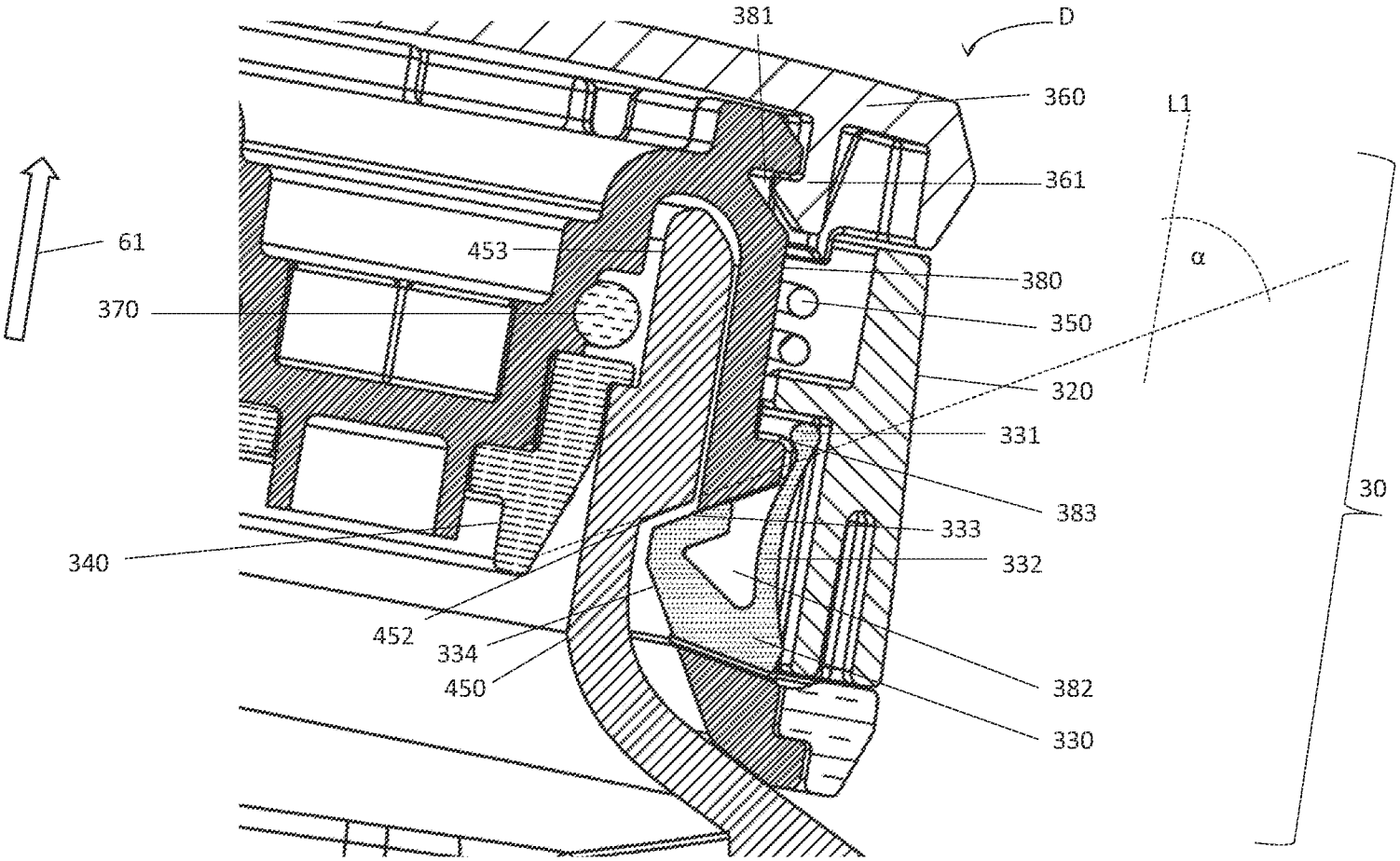
FIG. 9C is an illustration depicting cross-section view of cap structure 10 along section line C-C at enlargement zone D.

Reference is now made to FIGS. 9A, 9B and 9C. FIG. 9A is an illustration depicting a rear view the cap structure according to some embodiments of the invention, indicating a section line C-C. FIG. 9B is an illustration depicting a cross-section view of cap structure 10 along section line C-C and indicating an enlargement zone D. FIG. 9C is an illustration depicting cross-section view of cap structure 10 along section line C-C at enlargement zone D.

As shown in FIG. 9B, in a condition where cap 30 is attached to base 40, inwardly protruding projections 330 may snap onto and be juxtaposed to the annular step 452 at the neck 450 of base 40. This position may hold cap 30 firmly in place and attached to base 40.

When sleeve 320 is turned to the rotated position, as depicted in FIG. 8C, inwardly protruding projections 330 may meet respective inwardly facing dents 321 and may be free to retract thereto.

A user may then pull cap 30, and thus cause annular step 452 to push protruding projections 330 into respective inwardly facing dents 321, allowing cap 30 to detach from neck 450 of base 40. Additionally, or alternatively, a user may continue to rotate sleeve 320 (and thus annular stopper 340, coupled to sleeve 320 via spring 350 and chassis 350), causing slanted indentations (e.g., indentations 341 of FIG. 7) of annular stopper 340 to cooperate with the slanted portions of inlayed ridge (e.g., inlayed ridge 460 of FIG. 4B) to raise cap 30 over neck 450 of base 40.

As shown in FIG. 9B, cap 30 may include a ring gasket 370, attached to chassis 380. Ring gasket 370 may be adapted to squeeze against chassis 380 when the cap is closed, so as to seal container 20 and prevent flow of liquid therefrom via neck 450.

As shown in FIG. 9C, plate 360 may include one or more protrusions 361, configured to snap onto respective one or more apertures 381 in chassis 380, so as to attach chassis 380 to plate 360.

As shown in FIG. 9C, chassis 380 may include a plurality of apertures 382, adapted to house a respective plurality of protruding projections 330. When cap 30 is attached to neck 450 and positioned in the first, default position, the plurality of apertures 382 may house a respective plurality of protruding projections 330 so as to bring first face 333 of protruding projections 330 into contact with a slanted face of step 452. As explained in relation to FIG. 3B, annular step 452 may be slanted (e.g., as marked by angle $\alpha$) in relation to a line substantially parallel to a wall of the neck (e.g., as marked by line L1). The plurality of apertures 382 may house a respective plurality of protruding projections 330 so at to align first face 333 of protruding projections 330 at the same angle with the slanted face of step 452.

As elaborated herein in relation to FIG. 4B, cap 30 may be mounted onto neck 450 of base 40 by moving it in a linear motion indicated by arrow 60, so as to seal neck 450. When cap 30 is linearly pushed at the direction of arrow 60, second face 334 of the plurality of projections 330 may meet a respective face 453 of neck 450. As cap 30 is further pushed at the direction of arrow 60, flexible portion 332 may be contracted so as to enable face 334 to overcome flange 451, until face 333 comes into contact with respective slanted face 452 and cap 30 may be attached to neck 450 of base 40.

When cap 30 is attached to neck 450 and positioned in the first, default position, sleeve 320 may hold inwardly protruding projections 330 so as to force first face 333 to interface with the slanted face of annular step 452 and thus attach cap 30 to neck 450.

When cap 30 is positioned at the second, rotated position, inwardly protruding projections 330 may face respective inwardly facing recessed portions or dents (e.g., dents 321 of FIG. 8C) of sleeve 320. At this position, projections 330 may be allowed to retract into the respective dents 321. In this state, first face 333 of protruding projections 330 may disconnect from the slanted face of annular step 452 and may thus enable detachment of cap 30 from neck 450 by a linear motion (e.g., as indicated by arrow 61).

It may be appreciated that embodiments of the invention may provide an improvement over state-of-the-art container caps by simplifying motion required for attachment and/or detachment of cap 30 from base 40. Such simplification may be especially beneficial in conditions where a user may have limited motion capabilities, such as in a case of a handicapped user or a user who may be practicing sport while drinking from the container.

For example, state-of-the-art container caps may require screwing the cap onto a container or onto a base element by a rotation motion. In order to provide firm closure of the cap, such solutions normally require relatively long rotation of the cap in relation to the respective container (e.g., along two thirds of the container's perimeter). In contrast, the snapping of protruding projections 330 over step 452 of neck 450 may provide the required firmness of closure, whereas releasing of protruding projections 330 from step 452 may only require a slight twisting motion (e.g., along a quarter of the container's perimeter) until protruding projections 330 may meet the respective recessed portions or dents 321 and retract therein.

In another example, embodiments of the invention may allow a user to firmly seal container 20 by plugging cap 30 into neck 450 in a direct, straight motion (as depicted by arrow 60 of FIG. 4B) while the snapping of protruding projections 330 over step 452 may hold the cap firmly in place.

In yet another example, when cap 30 is attached to base 40, the one or more slanted indentations 341 of cap 30 may cooperate with the one or more slanted portions of inlayed ridge 460 of base 40 to prevent rotational movement of cap 30 in relation to base 40. After sleeve 320 is turned to the rotated position, allowing protruding projections 330 to retract into the respective recessed portions or dents 321, additional twisting of sleeve 320 (and hence of chassis 380, coupled to sleeve 320 via spring 350) may cause slanted indentations 341 to cooperate with the slanted portions of inlayed ridge 460 to raise cap 30 over neck 450 of base 40.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

Further, features or elements of different embodiments may be used with or combined with other embodiments.

The invention claimed is:

1. A cap structure comprising:

a base, comprising:

a periphery, configured to be mounted over a rim of an opening of a container;

a hollow neck, extending from the base for facilitating flow of liquid from the container through and out of the neck; and a flange, extending annularly around the neck, so as to define an annular step, and a cap, comprising a plurality of inwardly protruding projections configured to snap over the step when the cap is mounted over the neck, wherein the cap comprises a rotatable sleeve configured to engulf the plurality of inwardly protruding projections, the rotatable sleeve being further configured to rotate between a first default position to a second rotated position, wherein, in the first default position, the sleeve prevents the plurality of inwardly protruding projections from retracting so as to hold the cap onto the neck, wherein, in the second rotated position, the sleeve is configured to allow each of the plurality of inwardly protruding projections to retract so as to allow removal of the cap from the neck, and wherein the sleeve is coupled to a spring which holds the sleeve in the first default position.

2. The cap structure of claim 1, wherein the sleeve comprises inwardly facing dents, wherein, in the second rotated position, each of the inwardly facing dents faces an inwardly protruding projection of said plurality of inwardly protruding projections, such that each of the plurality of inwardly protruding projections may retract into one of the inwardly facing dents, allowing removal of the cap from the neck.

3. The cap structure of claim 1, wherein the cap comprises an annular stopper adapted to enter the hollow neck, and wherein an inner side of the hollow neck comprises an inlayed ridge adapted to cooperate with the annular stopper so as to stop a motion of the cap when the cap is pressed shut.

4. The cap structure of claim 3, wherein the annular stopper is associated with the sleeve, wherein the inlayed ridge comprises one or more portions that are slanted in relation to an axis parallel to a direction of mounting or dismounting of the cap from the neck, and wherein the annular stopper comprises one or more slanted indentations matching to the one or more slanted portions of the inlayed ridge and configured to cooperate with the one or more slanted portions of the inlayed ridge, so as to raise the cap with respect to the neck when the sleeve is turned.

5. The cap structure of claim 3, wherein the cap further comprises a chassis, attached to the spring on a first side, and thus coupled to the sleeve on the first side, and attached to the annular stopper on a second side.

6. The cap structure of claim 5, wherein the chassis further comprises a plurality of apertures, adapted to respectively house the plurality of inwardly protruding projections, while enabling the protruding projections to reach the annular step when the cap is closed.

7. The cap structure of claim 5, wherein the cap further comprises a ring gasket adapted to seal a gap between the chassis and the hollow neck, to prevent leakage of fluid therethrough.

8. The cap structure of claim 5, wherein the spring is fixed at a first end in an aperture comprised in the chassis, and thus attached to the chassis and wherein the spring is fixed at a second end in an aperture comprised in the sleeve, thus coupling the chassis to the sleeve, so as to allow a user to rotate the sleeve in relation to the chassis from the first default position to the second rotated position, and return the sleeve back to the first default position when the rotation stops.

9. The cap structure of claim 1, wherein the cap further comprises a ring, having a first protrusion, wherein the base further comprises a respective, second protrusion, and wherein the first protrusion and second protrusion are connectable by a lace, so as to secure the cap.

10. A container assembly comprising:

a container configured to hold liquid;

a base, comprising:

a periphery configured to be mounted over a rim of an opening of the container;

a hollow neck, extending from the base for facilitating flow of the liquid therethrough; and a flange extending annularly around the neck, so as to define an annular step, and a cap comprising a plurality of inwardly protruding projections, configured to snap over the step when the cap is mounted over the neck, wherein the cap comprises a rotatable sleeve configured to engulf the plurality of inwardly protruding projections, the rotatable sleeve being further configured to rotate between a first default position to a second rotated position, wherein in the first default position the sleeve prevents the plurality of inwardly protruding projections from retracting so as to hold the cap onto the neck, wherein, in the second rotated position, the sleeve is configured to allow each of the plurality of inwardly protruding projections to retract so as to allow removal of the cap from the neck, and wherein the sleeve is coupled to a spring which holds the sleeve in the first default position.

11. The container assembly of claim 10, wherein the sleeve comprises inwardly facing dents, wherein, in the second rotated position, each of the inwardly facing dents faces an inwardly protruding projection of said plurality of inwardly protruding projections, such that each of the plurality of inwardly protruding projections may retract into one of the inwardly facing dents, allowing removal of the cap from the neck.

12. The container assembly of claim 10, wherein the cap comprises an annular stopper adapted to enter the hollow neck, and wherein an inner side of the hollow neck comprises an inlayed ridge adapted to cooperate with the annular stopper so as to stop a motion of the cap when the cap is pressed shut.

13. The container assembly of claim 12, wherein the annular stopper is associated with the sleeve, wherein the inlayed ridge comprises one or more portions that are slanted in relation to an axis parallel to a direction of mounting or dismounting of the cap from the neck, and wherein the annular stopper comprises one or more slanted indentations matching to the one or more slanted portions of the inlayed ridge and configured to cooperate with the one or more slanted portions of the inlayed ridge, so as to raise the cap with respect to the neck when the sleeve is turned.

14. The container assembly of claim 12, wherein the cap further comprises a chassis, attached to the spring on a first side, and thus coupled to the sleeve on the first side, and attached to the annular stopper on a second side.

15. The container assembly of claim 14, wherein the chassis further comprises a plurality of apertures, adapted to respectively house the plurality of inwardly protruding projections, while enabling the protruding projections to reach the annular step when the cap is closed.

16. The container assembly of claim 14, wherein the cap further comprises a ring gasket adapted to seal a gap between the chassis and the hollow neck, to prevent leakage of fluid therethrough.

17. The container assembly of claim 14, wherein the spring is fixed at a first end in an aperture comprised in the chassis, and thus attached to the chassis, and wherein the spring is fixed at a second end in an aperture comprised in the sleeve, thus coupling the chassis to the sleeve, so as to allow a user to rotate the sleeve in relation to the chassis from the first default position to the second rotated position, and return the sleeve back to the first default position when the rotation stops.

18. The container assembly of claim 10, wherein the cap further comprises a ring, having a first protrusion, wherein the base further comprises a respective, second protrusion, and wherein the first protrusion and second protrusion are connectable by a lace, so as to secure the cap.

* * * * *